US006115033A

United States Patent [19]

Choi

[11] Patent Number: 6,115,033

[45] Date of Patent: Sep. 5, 2000

[54] VIDEO DISPLAY DEVICE AND A POWER SAVING METHOD THEREFOR

[75] Inventor: Chun-geun Choi, Kyungki-do, Rep. of Korea

[73] Assignee: SamSung Electronics Co., Ltd., Suwon, Rep. of Korea

[21] Appl. No.: 09/075,199

[22] Filed: May 11, 1998

[30] Foreign Application Priority Data

May 12, 1997 [KR] Rep. of Korea ..... 97-18178

[51] Int. Cl.[7] ..... G09G 5/00

[52] U.S. Cl. ..... 345/211; 345/210; 345/212; 345/214

[58] Field of Search ..... 345/169, 211, 345/212, 204, 210, 213, 214; 341/22; 348/554, 730

[56] References Cited

U.S. PATENT DOCUMENTS 5,410,305 4/1995 Barrus et al. ..... 341/22
5,659,371 8/1997 Krause ..... 348/730
5,808,693 9/1998 Yamashita et al. ..... 348/554
5,949,408 9/1999 Kang et al. ..... 345/169

*Primary Examiner*—Vijay Shankar
*Attorney, Agent, or Firm*—Robert E. Bushnell, Esq.

[57] ABSTRACT

Provided with a device for managing power in a power off mode, whereby the respective driving voltages generated from the voltage output section are controlled in the ultra power save mode by means of the soft power key, minimizing the power consumption in the display monitor, the device including: a soft power key for generating a key signal in response to the user's selection of ultra power save functions; a microcomputer storing a control program for controlling the output of a power off mode signal in response to the key signal generated from the soft power key; and a voltage output section turned on and off under the control of the power off mode signal generated from the microcomputer.

16 Claims, 5 Drawing Sheets

Fig. 2

| MODE | VIDEO | 5V | 8V | 12V | HIGH VOLTAGE (200V) | VOLUME OF POWER CONSUM PTION |
|---|---|---|---|---|---|---|
| NORMAL | ON | ON | ON | ON | ON | 80W |
| STAND BY | OFF | ON | ON | ON | ON | 65W |
| SUSPEND | OFF | ON | ON | OFF | OFF | 25W |
| DPMS OFF | OFF | ON | OFF | OFF | OFF | 5W |
| POWER OFF | OFF | ON | OFF | OFF | OFF | 5W |

Fig. 5

| MODE | VIDEO | 5V | | 8V | 12V | HIGH VOLTAGE (200V) | VOLUME OF POWER CONSUM PTION |
|---|---|---|---|---|---|---|---|
| | | MICOM | PERIPHERAL I/O | | | | |
| NORMAL | ON | ON | ON | ON | ON | ON | 80W |
| STAND BY | OFF | ON | ON | ON | ON | ON | 65W |
| SUSPEND | OFF | ON | ON | ON | OFF | OFF | 25W |
| DPMS OFF | OFF | ON | ON | OFF | OFF | OFF | 5W |
| POWER OFF | OFF | ON (SLEEP MODE) | OFF | OFF | OFF | OFF | 1 OR LESS W |

VIDEO DISPLAY DEVICE AND A POWER SAVING METHOD THEREFOR

CLAIM OF PRIORITY

This application makes reference to, incorporates the same herein, and claims all benefits accruing under 35 U.S.C. § 119 from an application entitled Device For And Method Of Managing Power During Power Off earlier filed in the Korean Industrial Property Office on May 12, 1997, and there duly assigned Serial No. 97-18178 by that Office.

BACKGROUND OF THE INVENTION

1. Field of the Invention

The present invention relates to a device for and method of managing power during a period when the power is off and, more particularly, to a circuit for and method of managing power in the power off mode, wherein the 5-volt power of a microcomputer is separately controlled such that the microcomputer enters the sleep mode in order to economize the power more effectively than the power save mode, that is, DPMS off mode.

2. Discussion of Related Art

Generally, a display device comprises control means for saving consumption power. In one approach, the control means may be implemented by a display power management system (DPMS), proposed by Video Electronics Standard Association (VESA) in U.S.A.

The DPMS functions to manage power of a display device, which is one of the peripheral devices of a computer, according to a used state of the computer to save the power.

In conformity with the VESA, the computer selectively supplies or blocks horizontal and vertical synchronous signals to the display device according to its used state, and the display device manages power according to the presence of the horizontal and vertical synchronous signals from the computer.

As an effort to save power for the display monitor, the DPMS mode is executed according to the presence of synchronous signals for synchronizing picture signals processed from a video card. For the DPMS mode, the microcomputer enters the standby mode, suspend mode and DPMS off mode in sequence according to the presence of synchronous signals.

The power management states are classified into an on state, a stand-by state, a suspend state and a power off state. Both the horizontal and vertical synchronous signals are applied at the on state, and only the vertical synchronous signal is applied at the stand-by state. Only the horizontal synchronous signal is applied at the suspend state, and either the horizontal or vertical synchronous signal is not applied at the power off state.

The power management state is sequentially changed to the on state stand-by state suspend state power off state with the continuous lapse of unused time of the computer. It is commonly prescribed that consumption power of the display device be about 80 W at the on state, 65 W or less at the stand-by state, 25 W or less at the suspend state and 5 W or less at the power off state.

An exemplary display monitor employing the DPMS mode will now be described. A computer is composed of a central processing unit (CPU) for processing a received keyboard signal, and a video card for processing data output from the CPU into RGB picture signals. The video card also generates horizontal and vertical sync signals for synchronizing the RGB picture signals.

A display monitor displays the RGB picture signals received from the video card and is composed of a control key section for generating a key signal to regulate the screen of the display monitor. A microcomputer receives to the horizontal and vertical sync signals from the video card and the key signal from the control key section. The microcomputer generates an image adjusting signal and a reference oscillating signal in response to the key signal. A horizontal and vertical output circuit section synchronizes the RGB picture signals in response to the image adjusting signal and the reference oscillating signal from the microcomputer. A video circuit section amplifies the RGB picture signals received from the video card 120. A power circuit section supplies a driving voltage to the microcomputer, the horizontal and vertical output circuit section and the vide circuit section.

The horizontal and vertical output circuit section includes a horizontal/vertical oscillating signal processor which receives the image adjusting signal and the reference oscillating signal from the microcomputer and generates horizontal and vertical oscillating pulses to control the switching rate of a sawtooth generating circuit in accordance with the horizontal and vertical sync signals received from the video card. A vertical drive circuit boosts the vertical oscillating pulse, generating a drive current. The most commonly used vertical drive circuit is a single-stage vertical amplifier, especially, an emitter-follower type amplifier wherein the transistor receives an input at its base and draws the output voltage at its emitter. Accordingly, it improves linearity than gain. Receiving the drive current amplified from the vertical drive circuit, a vertical output circuit sends a sawtooth current corresponding to the vertical synchronizing pulse to a deflection yoke, thereby determining a vertical scanning period. A horizontal drive circuit boosts the horizontal oscillating pulse received from the horizontal and vertical oscillating signal processor so as to generate a drive current sufficient to switch a horizontal output circuit. Receiving the drive current from the horizontal drive circuit, the horizontal output circuit generates a sawtooth current corresponding to the horizontal synchronizing pulse to the deflection yoke, determining a horizontal scanning period. There are two driving methods of the horizontal drive circuit: an in-phase method wherein the output is ON with the drive terminal ON, and out-of-phase method wherein the output is OFF when the drive terminal is ON. A high voltage circuit and a flyback transformer are driven in response to the horizontal oscillating pulse applied from the horizontal and vertical oscillating signal processor and generate a high voltage. This high voltage is applied to the anode of the cathode ray tube (CRT), forming an anode surface of the CRT. A video pre-amplifier of the video circuit section boosts weak RGB picture signals received from the video card to a specified voltage level. For example, a weak signal of less than 1 peak-to-peak voltage (hereinafter, referred to as $V_{pp}$) is boosted to a 4 to 6 $V_{pp}$ signal. Thus amplified RGB picture signals are applied to a video output amplifier and are further amplified into a signal of 40 to 60 $V_{pp}$, supplying energy to the respective pixels on the screen of the CRT. The scanning period of the image displayed on the screen of the CRT is determined by the deflection yoke DY and the luminance of the image displayed on the screen is regulated on the anode surface of the CRT.

The power circuit section for supplying a driving voltage to display the RGB picture signals on the screen of the CRT is applied with an alternating current (AC) via an AC input. The AC is then sent to a degaussing coil which corrects the colors blotted due to the earth magnetic field or the other external environment into the original ones.

Further, the AC received from the AC input is rectified into a direct current (DC) via a rectifier and applied to a switching transformer. Receiving the DC from the rectifier, the switching transformer supplies all sorts of driving voltages to the interior blocks of the display monitor via a voltage regulator. In this case, an error which occurs in the driving voltage generated from the voltage regulator is detected by a pulse width modulation (PWM) IC. The PWM IC controls the switching time according to the detected error, stabilizing the output voltage of the voltage regulator.

In order to save power in the display monitor, the microcomputer enters the DPMS mode according to the presence of synchronous signals generated from the video card. As for the DPMS mode, the microcomputer enters the standby mode to interrupt the RGB picture signals when the horizontal sync signal is off, while it enters the suspend mode to interrupt the deflection voltage with the vertical sync signal off.

Once the horizontal and vertical sync signals are interrupted, the microcomputer executes the DPMS off mode to interrupt a secondary power of the switching transformer via the PWM IC, saving the power in the display monitor. When the user presses a soft power key, the same effect can be attained as in the DPMS off mode wherein the secondary power of the switching transformer is interrupted through the PWM IC.

The DPMS off mode and the power off mode caused by the pressed soft power key turn off the video signals applied to the CRT and the voltages generated from the voltage regulator while they turn on the driving voltage for the microcomputer and its peripheral I/O.

Such as in the conventional display monitor described above, the ultra power save mode is hardly achieved in the power off mode making use of the soft power key selected by the user because the DPMS mode brings the same power saving effect as the power off mode caused by the press of the soft power key.

SUMMARY OF THE INVENTION

Accordingly, the present invention is directed to a device for and method of managing power in the power off mode that substantially obviates one or more of the problems due to limitations and disadvantages of the related art.

An object of the present invention is to provide a device for and method of managing power in the power off mode, which is adapted to realize the ultra power save mode turning off the peripheral I/O exclusive of a microcomputer in the power off mode making use of the soft power key selected by the user in the display monitor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device for managing power in a power off mode includes: a soft power key for generating a key signal in response to the user's selection of ultra power save functions; a microcomputer storing a control program for controlling the output of a power off mode signal in response to the key signal generated from the soft power key; and a voltage output section turned on/off under the control of the power off mode signal generated from the microcomputer.

In another aspect of the present invention, there is provided a method of managing power in a power off mode including the steps of: (a) activating a normal operation of a display monitor for displaying picture signals generated from a video card; (b) checking the receipt of a power off mode signal arising from a soft power key pressed; (c) under receipt of the power off mode signal in step (b), microcomputer's entering a sleep mode by controlling a voltage output section in response to the power off mode signal; (d) checking the receipt of a clear signal for the power off mode signal arising from the soft power key pressed during a period when the microcomputer is in the sleep mode; and (e) under receipt of the clear signal for the power off mode signal, third returning to step (a) for clearing the sleep mode and performing the normal operation of the microcomputer.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 2 is a table that lists examples of the power saving functions in various power saving modes of the display monitor shown in FIG. 1;

FIG. 5 is a table that lists the power save functions in the respective modes of the display monitor according to the present invention shown in FIG. 3.

DETAILED DESCRIPTION OF PREFERRED EMBODIMENT

Figure 1:
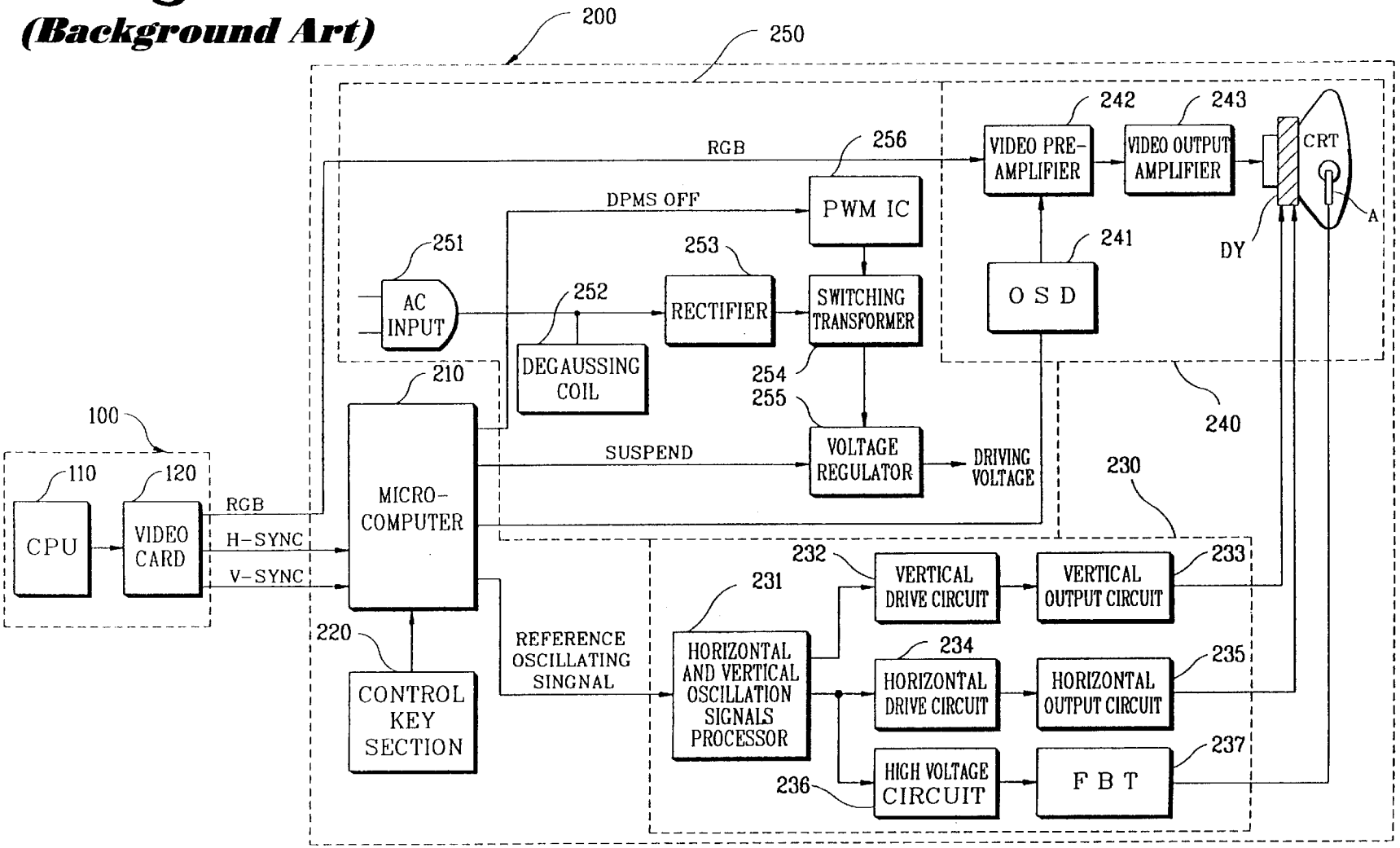
Fig. 1 (Background Art)
FIG. 1 is a block diagram of the internal circuit of an exemplary display monitor.

Referring to FIG. 1, the internal circuitry of an exemplary display monitor is shown in block diagram form. As shown in FIG. 1, a computer 100 is composed of a CPU 110 for processing a received keyboard signal, and a video card 120 for processing output data received from CPU 110 into RGB picture signals and for generating horizontal sync signals H-SYNC and vertical sync signals V-SYNC for synchronizing the RGB picture signals.

A display monitor 200 displays the RGB picture signals received from video card 120 is composed of a control key section 210 for generating a key signal to regulate the screen of the display monitor, a microcomputer 220 for receiving the horizontal and vertical sync signals, H-SYNC and V-SYNC, from video card 120 and for generating an image adjusting signal and a reference oscillating signal in response to the key signal sent from the control key section 210, a horizontal and vertical output circuit section 230 for synchronizing the RGB picture signals in response to the image adjusting signal and the reference oscillating signal from microcomputer 220; a video circuit section 240 for amplifying the RGB picture signals received from video card 120; and a power circuit section 250 for supplying driving voltages to microcomputer 220, horizontal and vertical output circuit section 230 and video circuit section 240.

Microcomputer 220 receives the horizontal and vertical sync signals, H-SYNC and V-SYNC, sent from video card 120 in computer 100, and generates an image adjusting signal and a reference oscillating signal in response to the key signal applied from control key section 210.

Upon receipt of the image adjusting signal and the reference oscillating signal from microcomputer 220, a horizontal and vertical oscillating signal processor 231 generates horizontal and vertical oscillating pulses to control the switching rate of a sawtooth generating circuit in accordance with the horizontal and vertical sync signals, H-SYNC and V-SYNC, received from video card 120.

A vertical drive circuit 232 boosts the vertical oscillating pulse to generate a drive current. The most commonly used vertical drive circuit 232 is a single-stage vertical amplifier, especially, an emitter-follower type amplifier wherein the transistor receives an input at its base and draws the output voltage at its emitter. Accordingly, it improves linearity than gain. Receiving the drive current amplified from vertical drive circuit 232, a vertical output circuit 233 sends a sawtooth current corresponding to the vertical synchronizing pulse to a deflection yoke DY, thereby determining a vertical scanning period.

A horizontal drive circuit 234 boosts the horizontal oscillating pulse received from horizontal and vertical oscillating signal processor 231 so as to generate a drive current sufficient to switch a horizontal output circuit 235. Receiving the drive current from horizontal drive circuit 234, horizontal output circuit 235 generates a sawtooth current corresponding to the horizontal synchronizing pulse for application to the deflection yoke DY, thereby determining a horizontal scanning period.

There are two driving methods of horizontal drive circuit 234, an in-phase method wherein the output is ON with the drive terminal ON and out-of-phase method wherein the output is OFF when the drive terminal is ON.

In order to supply a high voltage to an anode A of the CRT, a high voltage circuit 236 and a flyback transformer 237 is driven in response to the horizontal oscillating pulse applied from horizontal and vertical oscillating signal processor 231 and generates a high voltage. This high voltage is applied to anode A of the CRT, forming an anode surface of the CRT.

Video pre-amplifier 240 of the video circuit section 240 boosts the weak RGB picture signals received from the video card 120 to a specified voltage level. For example, a weak signal of less than 1 $V_{pp}$ is boosted to a 4 to 6 $V_{pp}$ signal level. The amplified RGB picture signals are then applied to a video output amplifier 242 and further amplified into a signal of 40 to 60 $V_{pp}$, for supplying necessary energy to display the respective pixels on the screen of the CRT.

Regarding the image created from the RGB picture signals displayed through the CRT, the scanning period is determined by the deflection yoke DY and the luminance of the image displayed on the screen is regulated on the anode surface of the CRT.

Power circuit section 250, for supplying a driving voltage to display the RGB picture signals on the screen of the display monitor, is supplied with an AC voltage via an AC input 251. The AC voltage is then sent to a degaussing coil 252, which corrects the colors blotted due to the earth magnetic field or the other external environment into the original ones.

Further, the AC voltage received from AC input 251 is rectified into a DC voltage via a rectifier 253 and applied to a switching transformer 254. Receiving the DC voltage from rectifier 253, switching transformer 254 supplies all sorts of driving voltages to the interior blocks of display monitor 200 via a voltage regulator 255. In this case, an error which occurs in the driving voltage generated from voltage regulator 255 is detected by a PWM IC 256. PWM IC 256 controls the switching time according to detected error, stabilizing the output voltage of voltage regulator 255.

In order to save power in display monitor 200, microcomputer 220 enters the DPMS mode according to the presence or absence of the horizontal and vertical sync signals, H-SYNC and V-SYNC, generated from video card 120. As for the DPMS mode, microcomputer 220 enters the standby mode to interrupt the RGB picture signals when the horizontal sync signal H-SYNC is off and the vertical sync signal V-SYNC is on, while it enters the suspend mode to interrupt the deflection voltage when the vertical sync signal V-SYNC off and the horizontal sync signal H-SYNC is on.

When both of the horizontal and vertical sync signals, H-SYNC and V-SYNC are interrupted, microcomputer 220 executes the DPMS off mode to interrupt a secondary power of switching transformer 254 via PWM IC 256, thereby saving power in display monitor 200. When the user presses a soft power key (not shown), the same effect can be attained as in the DPMS off mode wherein the secondary power of switching transformer 254 is interrupted through PWM IC 256.

The DPMS power saving modes, i.e., the normal mode, the standby mode, the suspend mode and the DPMS off mode, and the power consumed for each mode is shown in FIG. 2. Also, shown in FIG. 2 is the power consumption during the power off mode entered into in response to the activation of the soft power key. Voltage regulator 255 has circuitry (not shown) for outputting four different voltages, i.e., 5 volts, ±8 volts, ±12 volts and 200 volts, and FIG. 2 shows which of those voltages are on or off depending on the current power saving mode.

As shown in FIG. 2, the DPMS off mode, and the power off mode caused by the pressed soft power key, turn off the video signals applied to the CRT and the voltages (±8 volts, ±12 volts, 200 volts) generated from voltage regulator 255, while the driving voltage of 5 volts generated from voltage regulator 255 for microcomputer 210 remains on.

An ultra power save mode, in the exemplary display monitor described above, is not achieved in the power off mode making use of the soft power key selected by the user because the DPMS mode brings the same power saving effect as the power off mode caused by the pressing of the soft power key.

Figure 3:
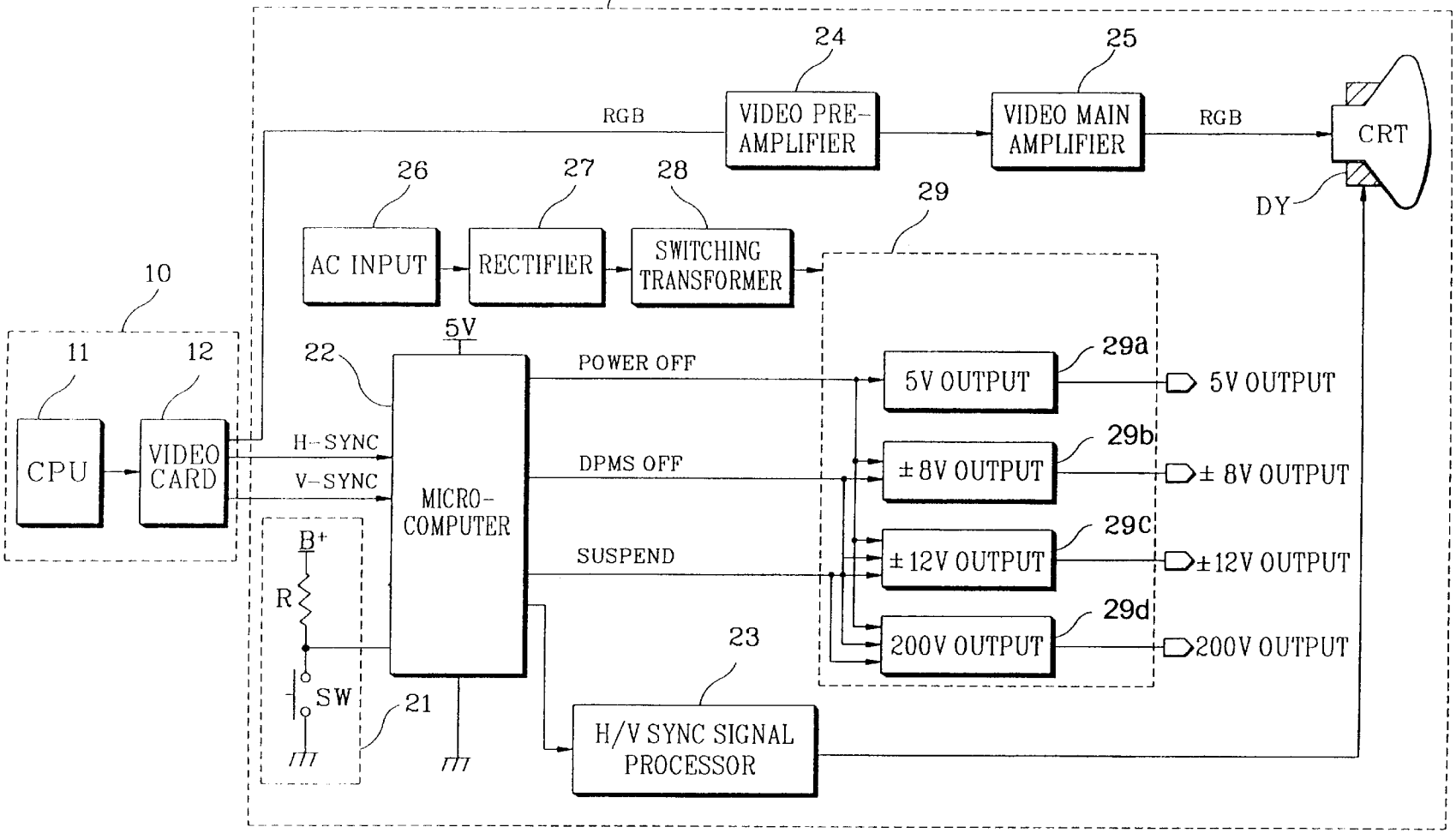
Fig. 3 (Background Art)
FIG. 3 is a block diagram of the internal circuit of a display monitor employing the power management device of the present invention.

FIG. 3 is a block diagram of the internal circuit of a display monitor employing the power management device of the present invention.

As shown in FIG. 3, a computer 10 is composed of a CPU 11 for generating output data resulting from the execution of a program selected by the user, and a video card 12 for processing the output data received from CPU 11 into RGB picture signals, and for generating horizontal and vertical sync signals, H-SYNC and V-SYNC, for synchronizing the RGB picture signals.

Display monitor 20 which synchronizes and displays the RGB picture signals received from the computer 10 is composed of a soft power key 21 for generating a key signal according to the user's selection of an ultra power saving function, a microcomputer 22 for generating a DPMS mode signal, an oscillating signal and an image adjusting signal according to the presence of horizontal and vertical sync signals, H-SYNC and V-SYNC, received from video card 12 of computer 10, and for controlling the output of a power off mode signal in response to the key signal generated from soft power key 21, a horizontal and vertical deflection circuit 23 receptive to the oscillating signal and the image adjusting signal from microcomputer 22, and generating a sawtooth current for application to a deflection yoke DY; a video pre-amplifier 24 for boosting the RGB picture signals received from video card 12 in computer 10 to a specified level; a video main amplifier 25 for finally boosting the RGB picture signals amplified from vide pre-amplifier 24, and applying them to a CRT; an AC input 26 receiving an AC voltage; a rectifier 27 for rectifying the AC voltage received from AC input 26 to generate a DC voltage; a switching transformer 28 for switching the DC voltage received from rectifier 27, and inducing it into a secondary current; and a voltage output section 29 for rectifying the secondary current of switching transformer 28 and generating driving voltages to be supplied to the internal circuit blocks of display monitor 20 as controlled in response to the power off mode signal, the DPMS off mode signal and a suspend signal generated from microcomputer 22. Note that the supply voltage of 5V applied to microcomputer 22 is not provided by voltage output section 29, but is instead derived from, for example, a D-sub connector connecting the computer main body to the monitor.

Soft power key 21 is composed of a resistor R connected between a DC voltage $B^+$ and microcomputer 22, and a switch SW connected between resistor R and a ground terminal for turning on and off the key signal, output from resistor R, to the microcomputer 22.

Figure 4:
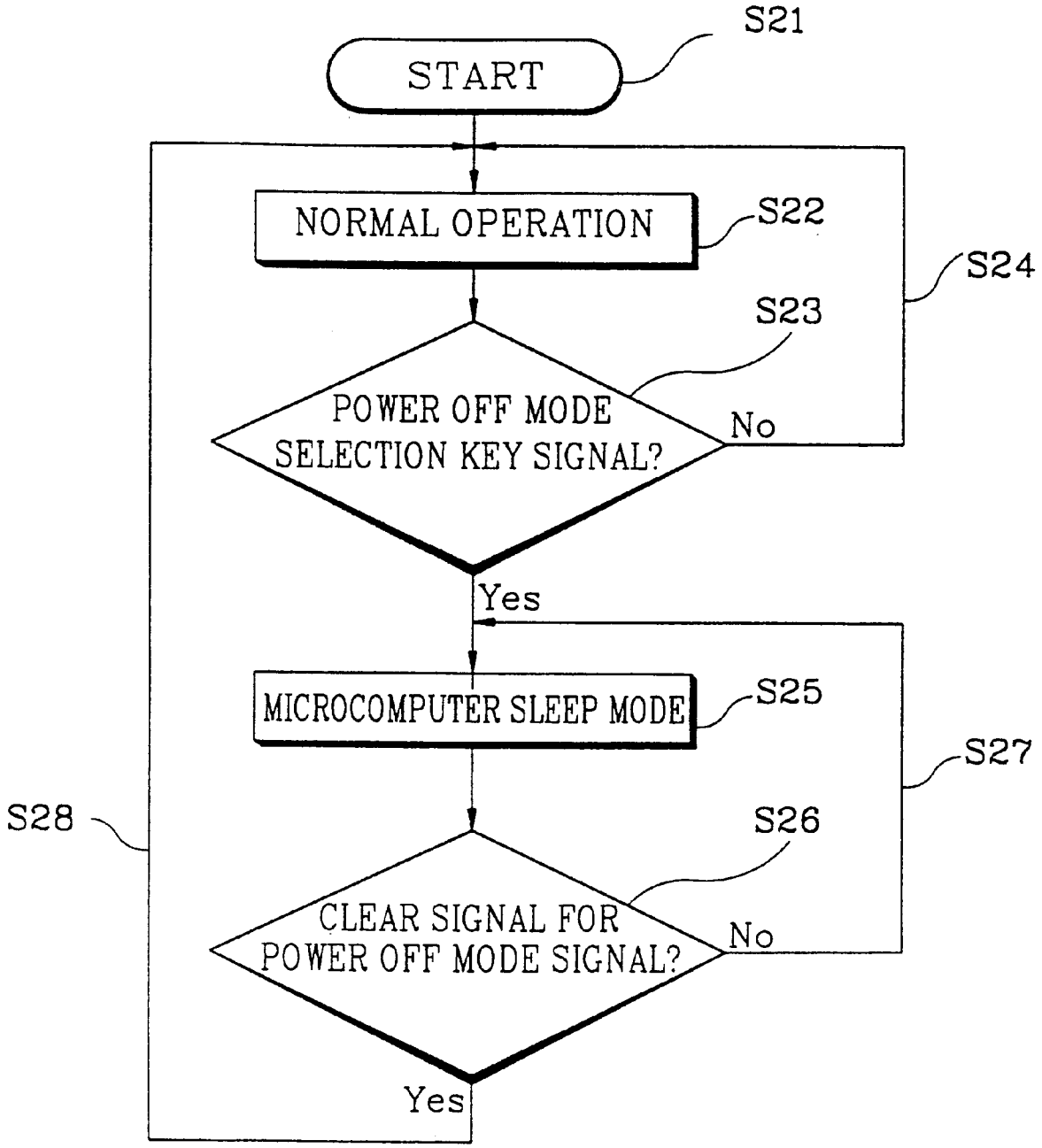
FIG. 4 is a flow chart illustrating a power management method in accordance with the present invention.

Voltage output section 29, which is switched in response to the power off mode signal POWER OFF generated from the microcomputer 22, is composed of a 5V output 29*a* for rectifying the secondary current of switching transformer 28 to generate 5 volts, a ±8V output 29*b* for rectifying the secondary current of switching transformer 28 to generate ±8 volts, a ±12V output 29*c* for rectifying the secondary current of switching transformer 28 to generate ±12 volts, and a 200V output 29*d* for rectifying the secondary current of the switching transformer 28 to generate 200 volts;

With reference to FIG. 4, there is described below the method of managing the power of the microcomputer 22 having a control program for controlling the power management device.

As shown in FIG. 4, the power management method includes the steps of: (S21) turning on the power of display monitor 20; (S22) performing a normal operation of the display monitor 20 to display picture signals generated from the video card 12; (S23) checking the receipt of a power off mode signal POWER OFF with pressing a soft power key 21 during the step S22; (S24) when the power off mode signal is not received in step S23, first returning to step S22 for waiting for the receipt of the power off mode signal; (S25) with the power off mode signal received, microcomputer 22 enters a sleep mode by controlling voltage output section 29 in response to the power off mode signal; (S26) checking the receipt of a clear key signal for the power off mode signal with pressing the soft power key 21 during the sleep mode in step S25; (S27) when the clear signal for the power off mode signal is not received in step S26, returning to step S25 for keeping the microcomputer in the sleep mode; and (S28) with the receipt of the clear signal for the power off mode signal, returning to step S22 by clearing the sleep mode of the microcomputer to perform a normal operation.

The power management operation of display monitor 20 is further described as follows in connection with FIGS. 4 and 5. In step S21, the user turns on the power to activate display monitor 20 by applying an AC voltage to rectifier 27 via AC input 26. Rectifier 27 rectifies the AC voltage into a DC voltage, which is applied to switching transformer 28. Switching transformer 28 switches the DC voltage to generate a second current to a voltage output section 29.

The current applied to voltage output section 29 from the switching transformer 28 passes through each of 5V output 29*a*, ±8V output 29*b*, ±12V output 29*c* and 200V output 29*d*, supplying driving voltages to the circuit blocks in the display monitor 20.

As the driving voltages activate the circuit blocks of display monitor 20 via the voltage output section 29 and the RGB picture signals are applied from video card 12 of computer 10, the RGB picture signals are displayed on the screen of the CRT in step S22.

In order for the display monitor 20 to display the RGB picture signals, video pre-amplifier 24 and video main amplifier 25 boost the RGB picture signals.

The RGB picture signals applied to the CRT are synchronized in accordance with horizontal and vertical sawtooth currents generated from deflection yoke DY, creating an image. Once the microcomputer 22 receives the horizontal and vertical sync signals, H-SYNC and V-SYNC, from the video card 12, the horizontal and vertical sawtooth current are generated from horizontal and vertical deflection circuits in horizontal and vertical signal processing circuit 23 in response to the oscillating signal and the image adjusting signal sent from microcomputer 22.

In the normal mode, as shown in FIG. 5, the video image created from the RGB picture signals is turned on, as is each of the 5V output 29*a*, ±8V output 29*b*, ±12V output 29*c* and 200V output 29*d*, supplying driving voltages to the circuit blocks in the display monitor 20. When microcomputer 22 receives the vertical sync signal V-SYNC, but does not receive the horizontal sync signal H-SYNC from video card 12 in the normal mode, it enters the standby mode, turning off the video image displayed on the CRT, but each of the 5V output 29*a*, ±8V output 29*b*, ±12V output 29*c* and 200V output 29*d* remain on.

When microcomputer 22 fails to receive the vertical sync signal V-SYNC, but does receive the horizontal sync signal H-SYNC from video card 12, the microcomputer 22 applies a suspend mode signal SUSPEND to the ±12V output 29*c* and 200V output 29*d* of voltage output section 29 to turn them off.

When microcomputer 22 receives neither the horizontal nor vertical sync signals, H-SYNC and V-SYNC, it sends a DPMS off mode signal DPMS OFF to the ±8V output 29*b*, ±12V output 29*c* and 200V output 29*d*, turning off these outputs.

Microcomputer 22 stores a control program which is processes the key signal generated from soft power key 21 in case the user presses soft power key 21 in the DPMS mode or in the normal mode of display monitor 20.

Once the user closes the switch SW of the soft power key 21, a key signal arising from the selection of power off mode signal POWER OFF is generated. Repressing the switch SW permits a clear signal for the power off mode signal POWER OFF to be generated. Also, the soft power key 21 applies the DC voltage $B^+$ to the resistor R, toggling it.

Upon the user's pressing the switch SW of soft power key 21, microcomputer 22 checks for receipt of the soft power mode signal, in step S23. If the soft power mode signal is not received, it returns to step S22, in step S24.

On the contrary, when detecting the soft power mode signal, microcomputer 22 generates a power off mode signal POWER OFF in step S25, turning off each of the 5V output 29*a*, ±8V output 29*b*, ±12V output 29*c* and 200V output 29*d* in voltage output section 29, as shown in FIG. 5. As noted previously, the supply voltage of 5V applied to microcomputer 22 is not provided by 5V output 29*a*, but is instead derived from, for example, a D-sub connector connecting the computer main body to the monitor, thus this supply voltage of 5V is not turned off.

In this case, the voltage of 5V from the 5V output 29*a* turns off the peripheral I/O (not shown) responsible for the I/O interface of microcomputer 22 exclusive of a wake-up voltage of 5V supplied to the microcomputer 22. The microcomputer 22 then checks whether a clear signal for the power off mode signal is received in response to the user again pressing soft power key 21, in step S26.

Where the clear key is not received in step S26, microcomputer 22 returns to step 25 for keeping the sleep mode, step S27. Under receipt of the clear key, it returns to step S22 for the normal mode, in step S28.

That is, microcomputer 22 detects the clear key signal arising from the soft power key 21 being pressed, turning on each of the 5V output 29*a*, ±8V output 29*b*, ±12V output 29*c* and 200V output 29*d* in the voltage output section 29, and accordingly, it is driven with the wake-up voltage of 5 volts.

As described above, the user controls the respective driving voltages generated from the voltage output section 29 making use of the soft power key 21, executing the power off mode in the display monitor 20, such that the microcomputer 22 enters the sleep mode to save the power to less than 1 W in maximum.

Such as in the present invention as described above, the respective driving voltages generated from the voltage output section are controlled in the ultra power save mode by means of the soft power key, thereby minimizing the power consumption in the display monitor.

It will be apparent to those skilled in the art that various modifications and variations can be made in the device for and method of managing the power in the power off mode according to the present invention without departing from the spirit or scope of the invention. Thus, it is intended that the present invention cover the modifications and variations of this invention provided they come within the scope of the appended claims and their equivalents.

What is claimed is:

1. A video display device having a power saving mode, said video display device being selectively operable in an ultra power saving mode, said video display device comprising:

voltage output means for generating plural direct current voltages in response to an input alternating current voltage, said plural direct current voltages comprising a 5V output, a ±8V output, a ±12V output and a 200V output;

a microcomputer for controlling said voltage output means by detecting inputs of a horizontal sync signal, a vertical sync signal and a key signal;

a soft power key for generating said key signal in response to user activation of said soft power key; and said microcomputer causing said video display device to be operable in said ultra power saving mode by controlling said voltage output means to prevent said 5V output, said ±8V output, said ±12V output and said 200V output when said key signal is first detected, said microcomputer controlling said voltage output means to enable said 5V output, said ±8V output, said ±12V output and said 200V output when said key signal is detected a second time during said ultra power saving mode.

2. The video display device as set forth in claim 1, further comprising:

said voltage output means generating said 5V output, said ±8V output, said ±12V output and said 200V output when said horizontal sync signal and said vertical sync signal are detected by said microcomputer during said power saving mode;

said voltage output means generating said 5V output, said ±8V output, said ±12V output and said 200V output when said horizontal sync signal is not detected and said vertical sync signal is detected by said microcomputer during said power saving mode;

said microcomputer controlling said voltage output means to prevent said ±12V output and said 200V output when said horizontal sync signal is detected by said microcomputer and said key signal and said vertical sync signal are not detected by said microcomputer during said power saving mode; and said microcomputer controlling said voltage output means to prevent said ±8V output, said ±12V output and said 200V output when said horizontal sync signal, said vertical sync signal and said key signal are not detected by said microcomputer during said power saving mode.

3. The video display device as set forth in claim 1, further comprising:

a horizontal and vertical sync signal processor for enabling an image to be displayed on a screen of a cathode ray tube of said video display device; and said microprocessor controlling said horizontal and vertical sync signal processor for preventing said image to be displayed on said screen during said ultra power saving mode.

4. The video display device as set forth in claim 2, further comprising:

a horizontal and vertical sync signal processor for enabling an image to be displayed on a screen of a cathode ray tube of said video display device; and said microprocessor controlling said horizontal and vertical sync signal processor for preventing said image to be displayed on said screen when one or both of said horizontal and vertical sync signals is not detected.

5. A power saving method for video display device having a power saving mode, said video display device being selectively operable in an ultra power saving mode, said method comprising the steps of:

generating plural direct current voltages in response to an input alternating current voltage for operating said video display device in said power saving mode upon power up of said video display device, said plural direct current voltages comprising a 5V output, a ±8V output, a ±12V output and a 200V output;

detecting whether or not a horizontal sync signal, a vertical sync signal and a key signal are input to a microcomputer of said video display device during said power saving mode, said horizontal sync signal and said vertical sync signal being output from a video card of a computer connected to said video display device, said key signal being generated in response to user activation of a soft power key; and operating said video display device in said ultra power saving mode by controlling said voltage output means to prevent said 5V output, said ±8V output, said ±12V output and said 200V output when said key signal is first detected.

6. The method as set forth in claim 5, further comprising a step of:

operating said video display device in said power saving mode by enabling said 5V output, said ±8V output, said ±12V output and said 200V output to again be generated when said key signal is detected a second time during said ultra power saving mode.

7. The method as set forth in claim 5, further comprising the steps of:

preventing an image from being displayed on a screen of a cathode ray tube of said video display device during said ultra power saving mode.

8. The method as set forth in claim 5, further comprising the steps of:

generating said 5V output, said ±8V output, said ±12V output and said 200V output when said horizontal sync signal and said vertical sync signal are detected by said microcomputer during said power saving mode;

generating said 5V output, said ±8V output, said ±12V output and said 200V output when said horizontal sync signal is not detected and said vertical sync signal is detected by said microcomputer during said power saving mode;

preventing said ±12V output and said 200V output from being generated when said horizontal sync signal is detected by said microcomputer and said key signal and said vertical sync signal are not detected by said microcomputer during said power saving mode; and preventing said ±8V output, said ±12V output and said 200V output when said horizontal sync signal, said vertical sync signal and said key signal are not detected by said microcomputer during said power saving mode.

9. The method as set forth in claim 8, further comprising the step of:

preventing an image from being displayed on a screen of a cathode ray tube of said video display device when one of said horizontal and vertical sync signals is not detected during said power saving mode.

10. The method as set forth in claim 8, further comprising the step of:

preventing an image from being displayed on a screen of a cathode ray tube of said video display device when neither of said horizontal and vertical sync signals are detected during said power saving mode.

11. A video display device having a display power management system (DPMS) mode including a plurality of power saving mode levels, one of said mode levels being an ultra power saving mode, said video display device comprising:

voltage output means for generating plural direct current voltages in response to an input alternating current voltage;

a soft power key for generating said key signal in response to user activation of said soft power key;

a microcomputer for controlling said voltage output means to be operable in different ones of said power saving mode levels by controlling said voltage output means to prevent generation of predetermined ones of said plural direct current voltages in response to an absence of said key signal and absence of one of a horizontal sync signal, a vertical sync signal and both horizontal and vertical sync signals; and said microcomputer causing said video display device to be operable in said ultra power saving mode by controlling said voltage output means to prevent generation of said plural direct current voltages when said key signal is first detected.

12. The video display device as set forth in claim 11, further comprising said microcomputer controlling said voltage output means to enable generation of said plural direct current voltages when said key signal is detected a second time during said ultra power saving mode.

13. The video display device as set forth in claim 11, further comprising:

said voltage output means generating said plural direct current voltages when said horizontal sync signal and said vertical sync signal are detected by said microcomputer during said DPMS mode;

said voltage output means generating said plural direct current voltages when said horizontal sync signal is not detected and said vertical sync signal is detected by said microcomputer during said DPMS mode;

said microcomputer controlling said voltage output means to prevent generation of two of said plural direct current voltages when said horizontal sync signal is detected by said microcomputer and said key signal and said vertical sync signal are not detected by said microcomputer during said DPMS mode; and said microcomputer controlling said voltage output means to prevent generation of three of said plural direct current voltages when said horizontal sync signal, said vertical sync signal and said key signal are not detected by said microcomputer during said DPMS mode.

14. The video display device as set forth in claim 11, further comprising:

a horizontal and vertical sync signal processor for enabling an image to be displayed on a screen of a cathode ray tube of said video display device; and said microprocessor controlling said horizontal and vertical sync signal processor for preventing said image to be displayed on said screen during said ultra power saving mode.

15. The video display device as set forth in claim 12, further comprising:

a horizontal and vertical sync signal processor for enabling an image to be displayed on a screen of a cathode ray tube of said video display device; and said microprocessor controlling said horizontal and vertical sync signal processor for enabling said image to be displayed on said screen when said key signal is detected said second time.

16. The video display device as set forth in claim 13, further comprising:

a horizontal and vertical sync signal processor for enabling an image to be displayed on a screen of a cathode ray tube of said video display device; and said microprocessor controlling said horizontal and vertical sync signal processor for preventing said image to be displayed on said screen when one or both of said horizontal and vertical sync signals is not detected.

* * * * *